US007918577B2

(12) United States Patent
Barker

(10) Patent No.: US 7,918,577 B2
(45) Date of Patent: Apr. 5, 2011

(54) LIGHT HOUSING

(76) Inventor: Robert Marshall Barker, Atlanta, GA (US)

( * ) Notice: Subject to any disclaimer, the term of this patent is extended or adjusted under 35 U.S.C. 154(b) by 116 days.

(21) Appl. No.: 12/137,940

(22) Filed: Jun. 12, 2008

(65) Prior Publication Data

US 2008/0310143 A1 Dec. 18, 2008

Related U.S. Application Data

(60) Provisional application No. 60/943,481, filed on Jun. 12, 2007.

(51) Int. Cl.
*F21V 33/00* (2006.01)

(52) U.S. Cl. ..... 362/99; 362/276; 362/604; 362/802; 40/124.02; 40/661.02

(58) Field of Classification Search ..... 362/98, 362/99, 101, 295, 276, 602, 604, 612, 802; 40/124.02, 661.02
See application file for complete search history.

(56) References Cited

U.S. PATENT DOCUMENTS 2,177,337 A * 10/1939 Stein ..... 362/802
6,152,575 A * 11/2000 Montanino ..... 362/802

* cited by examiner

*Primary Examiner* — Stephen F Husar
(74) *Attorney, Agent, or Firm* — Ballard Spahr LLP

(57) ABSTRACT

A device for use in a restaurant as a source of light for the table area comprising a housing, a power circuit and at least one light source. The housing has an integral base that is configured to support the housing on a table. The power circuit has a power source positioned therein the housing and a pressure switch. The at least one light source is positioned therein the housing proximate an aperture in the base and is electrically coupled to the power circuit. The pressure switch is configured to selectively open and close the power circuit such that the at least one light source can be selectively energized by either placing the housing on the table, such that the at least one light source is in a de-energized position, or lifting the housing upwardly away from the table, which energizes the at least one light source.

15 Claims, 4 Drawing Sheets

LIGHT HOUSING

CROSS-REFERENCE TO RELATED APPLICATIONS

This application claims priority to U.S. Provisional Application No. 60/943,481, filed on Jun. 12, 2007, which is incorporated in its entirety in the document by reference.

SUMMARY OF THE INVENTION

In one embodiment, the present invention is a device for use as a source of light for a table area in a restaurant, for example. In one aspect, the device can comprise a housing, a power circuit and at least one light source. In one aspect, the housing has an integral base that is configured to support the housing on a table. In a further aspect, at least one aperture is defined therein the base of the housing.

In another aspect, the power circuit comprises a power source positioned therein the housing and a pressure switch that extends into a first aperture of the at least one apertures. In a further aspect, one light source of the at least one light source can be positioned therein the housing proximate a second aperture of the at least one aperture and is electrically coupled to the power circuit.

In one embodiment of the present invention, the pressure switch is configured to selectively open and close the power circuit such that the at least one light source can be selectively energized by either placing the housing on the table, such that the at least one light source is in a de-energized position, or lifting the housing upwardly away from the table, which energizes the at least one light source.

BRIEF DESCRIPTION OF THE FIGURES

The accompanying drawings, which are incorporated in and constitute a part of this specification, illustrate several aspects described below and together with the description, serve to explain the principles of the invention.

DETAILED DESCRIPTION OF THE INVENTION

Figure 1:
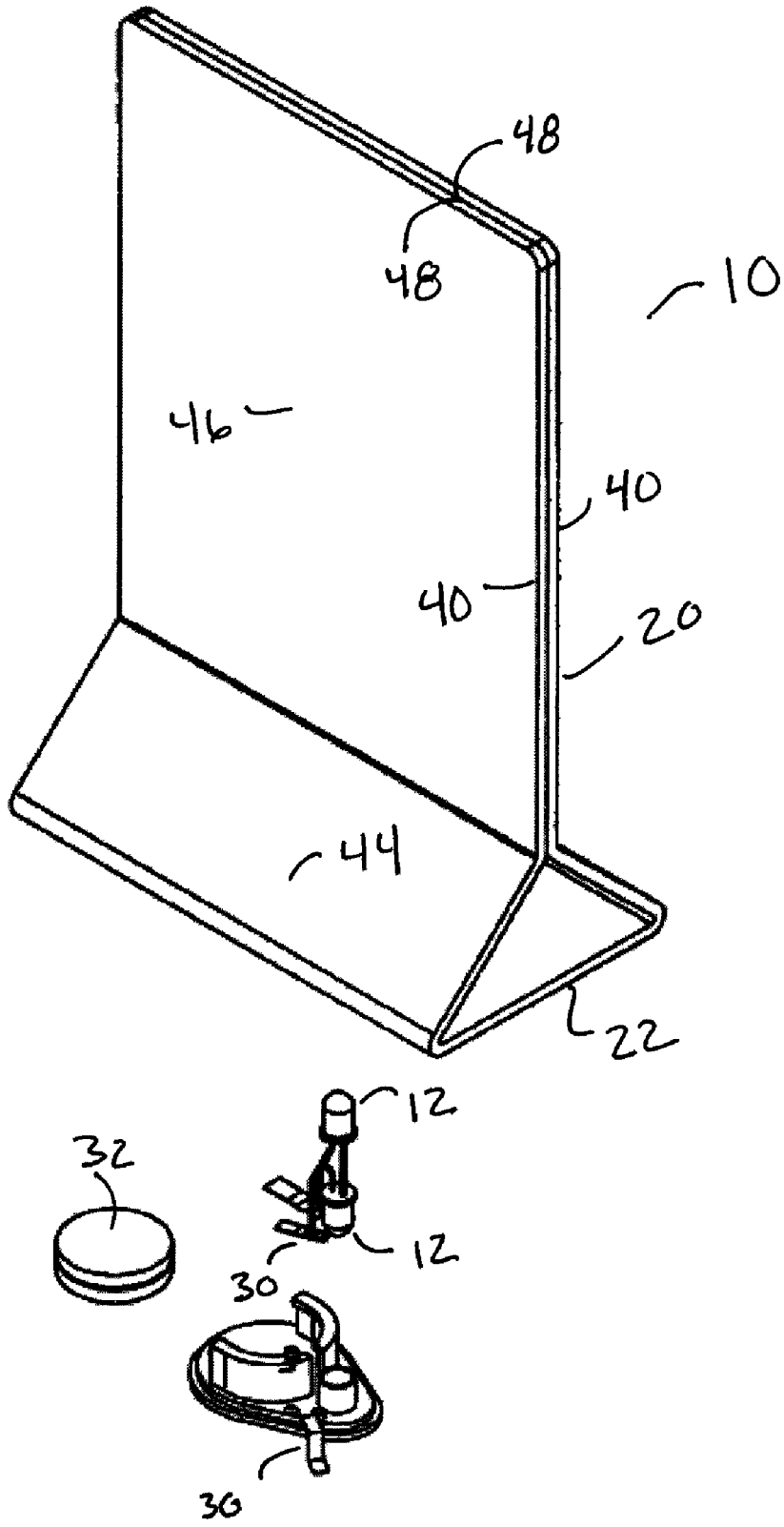
FIG. 1 is a perspective exploded view of one embodiment of the light housing of the present invention.
Figure 2:
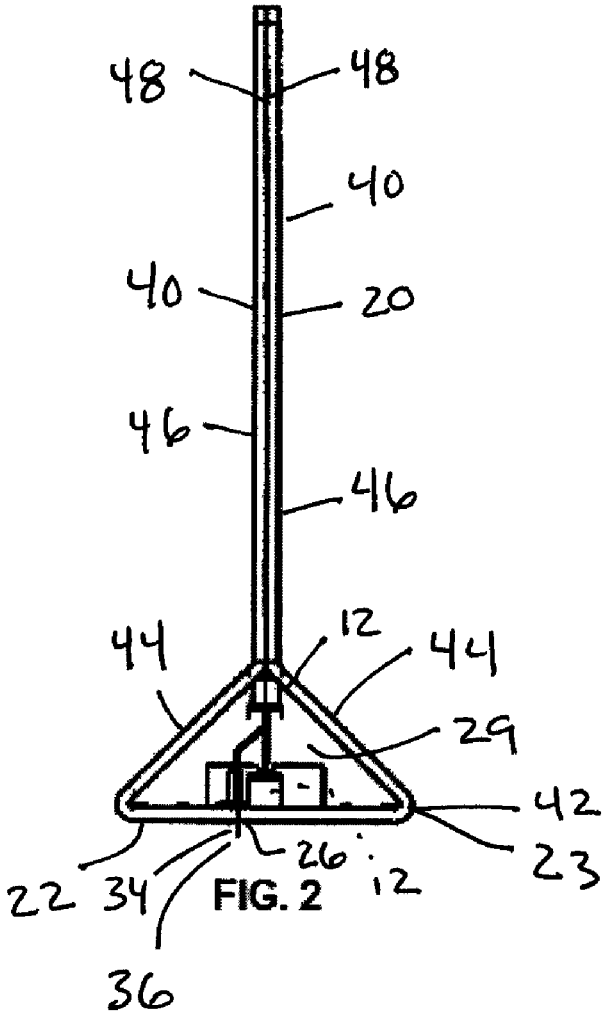
FIG. 2 is a side elevational view of the light housing of FIG. 1, showing one light source in communication with a portion of the side walls of a housing and a second light source positioned proximate the base of the housing and showing a distal end of a pressure switch extending therethrough a first aperture below the plane of the bottom surface of the base of the housing.
Figure 3:
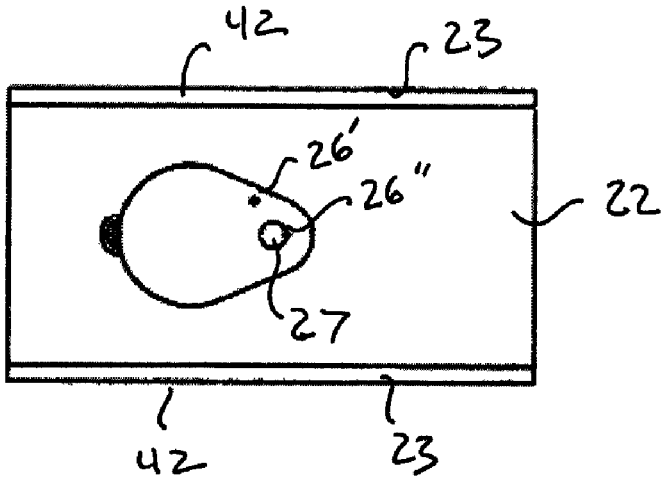
FIG. 3 is a bottom elevational view of the light housing of FIG. 1 showing a first aperture and a second aperture defined therein the base of the housing.
Figure 4:
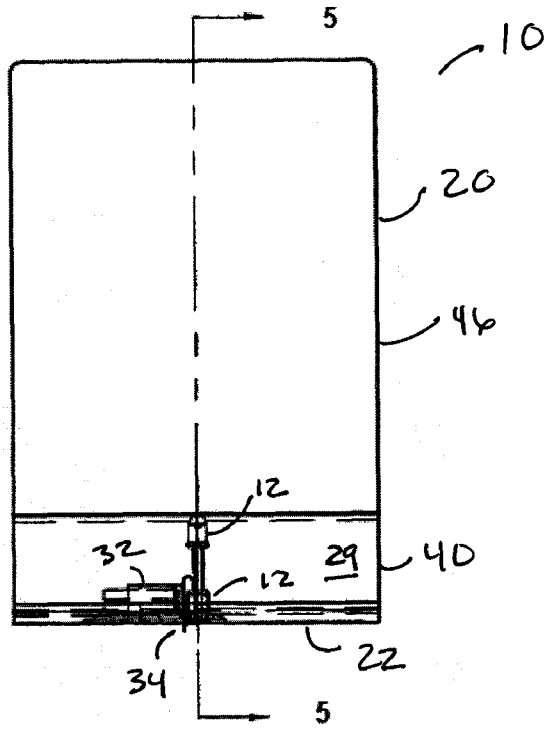
FIG. 4 is a side elevational transparent view of the light housing of FIG. 1.
Figure 5:
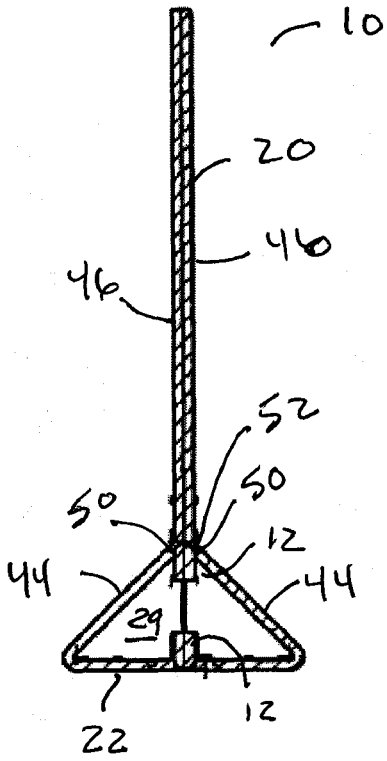
FIG. 5 is a cross-sectional view of the light housing of FIG. 1, taken across line 5-5 of FIG. 4.
Figure 6:
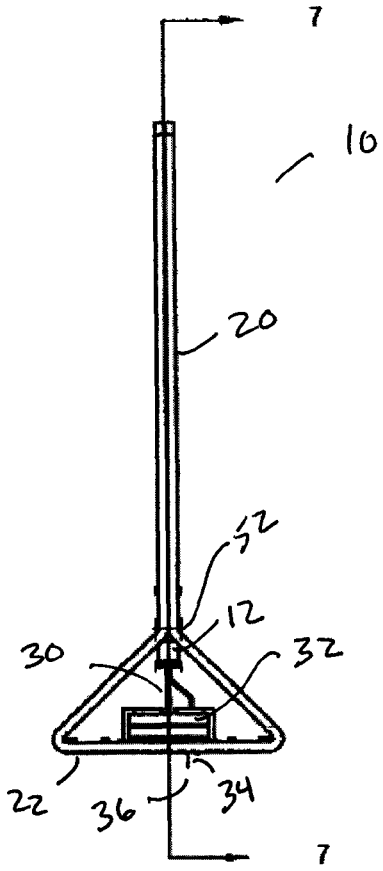
FIG. 6 is an end elevational view of the light housing of FIG. 1.
Figure 7:
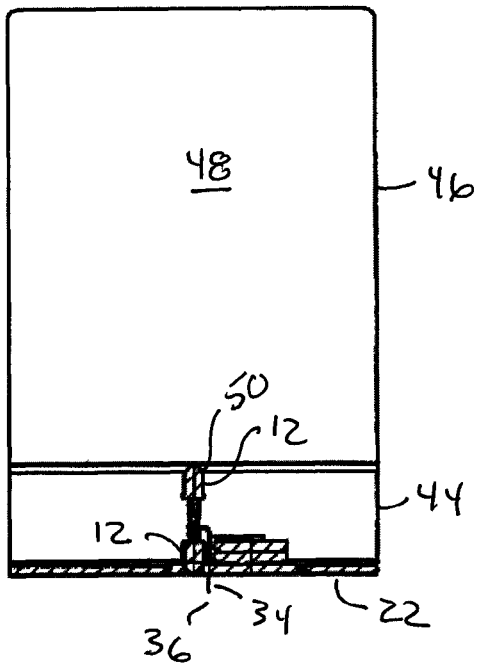
FIG. 7 is a cross-sectional view of the light housing of FIG. 1, taken across line 7-7 of FIG. 6.

The present invention can be understood more readily by reference to the following detailed description, examples, drawings, and claims, and their previous and following description. However, before the present device is disclosed and described, it is to be understood that this invention is not limited to the specific device disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise.

The present invention may be understood more readily by reference to the following detailed description of preferred embodiments of the invention and to the Figures and their previous and following description.

In one embodiment, the device 10 described herein can be used in an establishment, such as, for example, a restaurant, as a source of light for a table area. The device 10 can contain at least one light source 12 that can be energized selectively depending on the orientation of the device. For example, when the device is placed in an upright position on a table, it is de-energized, and can provide a mount for a displayed menu or advertisement. When the device is lifted from the table by a restaurant patron or other user, it can provide a portable light source for use as needed by the user and, optionally, can provide a light source for the displayed menu or advertisement.

In one aspect, the device 10 comprises a housing 20 having an integral base 22 to support the housing on a table. In another aspect, the base 22 can have a substantially planar bottom surface 24 and defines at least one aperture 26. In a further aspect, a power circuit 30 comprising a power source 32 and a pressure switch 34 can be positioned within the housing. In this aspect, the pressure switch 34 has a distal end 36 that is configured to be biased or urged to extend through a first aperture 26' that is defined therein the base of the housing. In a further aspect, the at least one light source 12 can be positioned within the housing and electrically coupled to the power circuit 30.

In a further aspect, at least a portion of the base 22 can be formed of a light transmissive material 28 such that the at least one light source 12 disposed therein the housing 20 can operatively transmit light or a light beam therethrough the light transmissive material. Optionally, one light source of the at least one light source can be positioned proximate a second aperture 26" defined therein the base by the housing. In this aspect, the device can comprise a light transmissive lens 27 that is mounted within the second aperture 26" in a position intermediate the bottom surface of the base and the light source 12 mounted proximate the second aperture.

In one embodiment, the pressure switch 34 can be movable about and between a first de-energized position and a second energized position. The first de-energized position is achieved when the housing is positioned on the table and the distal end of the pressure switch is positioned proximate the bottom surface of the base, but not extending beyond the plane of the bottom surface. In this position, the pressure switch causes the power circuit to be held open, leaving the at least one light source de-energized. The second energized position is achieved when the housing is lifted away from the table and the distal end of the pressure switch biases and extends outwardly beyond the plane of the bottom surface of the housing. In this energized position, the pressure switch 34 closes the power circuit, causing the at least one light source to be selectively powered.

In one aspect, the housing 20 defines an interior chamber 29 in which the power circuit and the at least one light source can be mounted and or positioned. Optionally, circuit components can be mounted so as to permit replacement on a modular basis. For example, it is contemplated that the power circuit and the at least one light source can comprise a light assembly that is releasably mountable in the base of the housing. In one example and not meant to be limiting, power source of the power circuit can be a DC battery that is removably mounted within the light assembly.

In a further aspect, the housing 20 can comprise a pair of opposing side walls 40. Each side wall of the pair of side walls has a bottom edge 42 integrally connected to one respective side edge 23 of a pair of longitudinally extending side edges 23 of the base 22 of the housing 20. Each side wall 40 has a first planar member 44 and a second planar member 46 that are connected to each other at a common edge. The first planar member 44, which is connected to the base and shares a common edge, is positioned at an acute angle with respect to the base 22. The second planar member 46 is positioned substantially transverse to the base and extends substantially parallel to a plane bisecting a longitudinal axis of the base.

Each second planar member 46 has an inner surface 48. In one aspect, the housing 20 is configured such that at least a portion of the inner surfaces 48 of each second planar member 46 are resiliently biased into contact with one another. Additionally, it is contemplated that the housing 20 of the device can be constructed from a single piece of molded plastic. Further, it is contemplated that at least a portion of the second planar members can be substantially transparent. In this aspect, the device is capable of holding and displaying information placed and frictionally held between its second planar members.

In a further aspect, a portion of the inner surface 48 of each second planar member 46 can define a slot 50 extending upwardly from the common edge. The slot in each second planar member can be positioned within each respective opposing side wall of the housing such that the respective slots 50 define a cavity 52 extending upwardly from the common edge between the firth and second planar members. In one aspect, the cavity 52 can be configured for operative receipt of one light source of the at least one light source 12. This enables the light to be transmitted in an upward direction from the light source when the light source is energized.

The preceding description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. The corresponding structures, materials, acts, and equivalents of all means or step plus function elements in the claims below are intended to include any structure, material, or acts for performing the functions in combination with other claimed elements as specifically claimed.

Accordingly, those who work in the art will recognize that many modifications and adaptations to the present invention are possible and can even be desirable in certain circumstances and are a part of the present invention. Other embodiments of the invention will be apparent to those skilled in the art from consideration of the specification and practice of the invention disclosed herein. Thus, the preceding description is provided as illustrative of the principles of the present invention and not in limitation thereof. It is intended that the specification and examples be considered as exemplary only, with a true scope and spirit of the invention being indicated by the following claims.

What is claimed is:

1. A device for use in a restaurant as a source of light for the table area, comprising:

a housing having an integral base to support the housing on a table, wherein the base has a bottom substantially planar surface and defines at least one aperture therein the base;

a power circuit comprising a power source positioned therein the housing and a pressure switch, wherein the pressure switch has a distal end that extends into a first aperture of the at least one aperture; and at least one light source positioned therein the housing and being electrically coupled to the power circuit, wherein one light source of the at least one light source is positioned proximate a second aperture of the at least one aperture;

wherein the housing defines an interior chamber in which the power circuit and the at least one light source are mounted, wherein the power circuit and the at least one light source comprise a light assembly, wherein the light assembly is releasably mountable in the base of the housing, and wherein the pressure switch is movable about and between a first de-energized position, in which the housing is positioned on the table and the distal end of the pressure switch is positioned proximate the bottom surface of the base such that the power circuit held open such that the at least one light source is not energized, and a second energized position, in which the housing is lifted away from the table and the distal end of the pressure switch extends outwardly beyond the bottom surface of the housing to close the power circuit and to selectively power the at least one light source.

2. The device of claim 1, wherein the power source of the power circuit is a DC battery; and wherein the DC battery is removably mounted therein the light assembly.

3. The device of claim 1, further comprising a light transmissive lens mounted therein the second aperture of the base intermediate the bottom surface of the base and the light source mounted proximate the second aperture.

4. The device of claim 1, wherein the base has a pair of opposing longitudinally extending side edges, and further comprising a pair of opposing side walls, each side wall of the pair of side walls having a bottom edge integrally connected to one respective side edge of the pair of longitudinally extending side edges, wherein each side wall further comprises a first planar member and a second planar member that are connected to each other at a common edge, wherein the first planar member is positioned at an acute angle with respect to the base and the second planar member is positioned substantially transverse to the base and extends substantially parallel to plane bisecting a longitudinal axis of the base.

5. The device of claim 4, wherein each second planar member has an inner surface, wherein at least a portion of the inner surfaces of each second planar member are resiliently biased into contact with each other.

6. The device of claim 5, wherein the housing is of a one-piece molded plastic construction.

7. The device of claim 5, wherein at least a portion of the second planar member is substantially transparent.

8. The device of claim 4, wherein a portion the inner surface of each second planar member defines a slot extending from the common edge; and wherein the slot in each second planar member is positioned within each respective opposing side wall such that the respective slots define a cavity extending upwardly from the common edge that is configured for operative receipt of one light source of the at least one light source.

9. A device for use in a restaurant as a source of light for the table area, comprising:

a housing having an integral base to support the housing on a table, wherein the base has a bottom substantially planar surface and defines at least one aperture therein the base, wherein the base has a pair of opposing longitudinally extending side edges, and further comprising a pair of opposing side walls, each side wall of the pair of side walls having a bottom edge integrally connected to one respective side edge of the pair of longitudinally extending side edges, wherein each side wall further comprises a first planar member and a second planar member that are connected to each other at a common edge, wherein the first planar member is positioned at an acute angle with respect to the base and the second planar member is positioned substantially transverse to the base and extends substantially parallel to plane bisecting a longitudinal axis of the base;

a power circuit comprising a power source positioned therein the housing and a pressure switch, wherein the pressure switch has a distal end that extends into a first aperture of the at least one aperture; and at least one light source positioned therein the housing and being electrically coupled to the power circuit, wherein one light source of the at least one light source is positioned proximate a second aperture of the at least one aperture;

wherein the pressure switch is movable about and between a first de-energized position, in which the housing is positioned on the table and the distal end of the pressure switch is positioned proximate the bottom surface of the base such that the power circuit held open such that the at least one light source is not energized, and a second energized position, in which the housing is lifted away from the table and the distal end of the pressure switch extends outwardly beyond the bottom surface of the housing to close the power circuit and to selectively power the at least one light source.

10. The device of claim 9, wherein each second planar member has an inner surface, wherein at least a portion of the inner surfaces of each second planar member are resiliently biased into contact with each other.

11. The device of claim 10, wherein the housing is of a one-piece molded plastic construction.

12. The device of claim 10, wherein at least a portion of the second planar member is substantially transparent.

13. The device of claim 9, wherein a portion the inner surface of each second planar member defines a slot extending from the common edge; and wherein the slot in each second planar member is positioned within each respective opposing side wall such that the respective slots define a cavity extending upwardly from the common edge that is configured for operative receipt of one light source of the at least one light source.

14. The device of claim 9, wherein the power source of the power circuit is a DC battery; and wherein the DC battery is removably mounted therein the light assembly.

15. The device of claim 9, further comprising a light transmissive lens mounted therein the second aperture of the base intermediate the bottom surface of the base and the light source mounted proximate the second aperture.

* * * * *